US006973740B2

(12) United States Patent
Meyer

(10) Patent No.: US 6,973,740 B2
(45) Date of Patent: Dec. 13, 2005

(54) STATIONARY CLOTHES DRYING APPARATUS

(75) Inventor: Robert W. Meyer, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/341,699

(22) Filed: Jan. 14, 2003

(65) Prior Publication Data

US 2004/0134087 A1 Jul. 15, 2004

(51) Int. Cl.[7] ..... F26B 19/00; F26B 25/06

(52) U.S. Cl. ..... 34/224; 34/225; 34/230; 34/202

(58) Field of Search ..... 34/224, 225, 603, 34/604, 230, 90, 103, 104, 202

(56) References Cited

U.S. PATENT DOCUMENTS

| | | | | | |
|---|---|---|---|---|---|
| 11,460 | A | * | 8/1854 | Proctor | 172/722 |
| 502,237 | A | * | 7/1893 | Proctor | 312/301 |
| 805,935 | A | * | 11/1905 | Schwartz | 34/196 |
| 1,013,042 | A | * | 12/1911 | Mossop | 223/75 |
| 3,501,846 | A | * | 3/1970 | Melega | 34/103 |
| 3,501,847 | A | * | 3/1970 | Sanford et al. | 34/103 |
| 4,471,537 | A | * | 9/1984 | Meda | 34/77 |
| 4,750,276 | A | * | 6/1988 | Smith et al. | 34/612 |
| 5,152,077 | A | * | 10/1992 | Liang | 34/77 |
| 5,555,640 | A | * | 9/1996 | Ou | 34/202 |
| 5,666,743 | A | * | 9/1997 | Dawson | 34/219 |
| 5,755,040 | A | * | 5/1998 | Ou | 34/202 |
| 5,870,836 | A | | 2/1999 | Grimes | 34/202 |

* cited by examiner

*Primary Examiner*—Kenneth Rinehart
(74) *Attorney, Agent, or Firm*—John F. Colligan; Robert O. Rice; Stephan Krefman

(57) ABSTRACT

A stationary dryer, which may be used for drying clothes, is provided having a housing enclosing a space. A stationary support is located within the space for receiving articles to be dried. An air moving device is provided for generating an air flow through the space from an air inlet to an air outlet. An air distributor mechanism comprising a distribution plenum is positioned between the air inlet and the stationary support, with a plenum wall having a plurality of perforations therein. At least one of the distribution plenum and the perforations are sized, shaped and arranged so as to equalize an air flow distribution over the stationary support.

31 Claims, 7 Drawing Sheets

FIG. 15
FIG. 15A
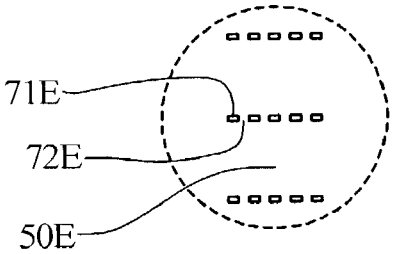
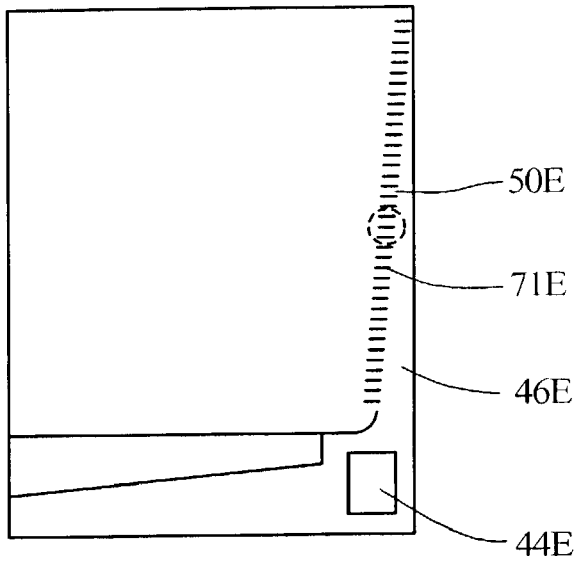
FIG. 16
FIG. 16A
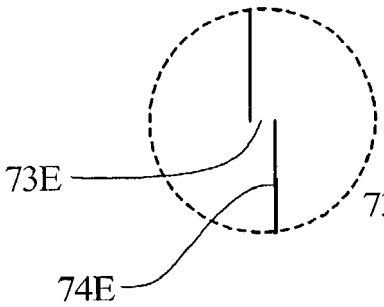
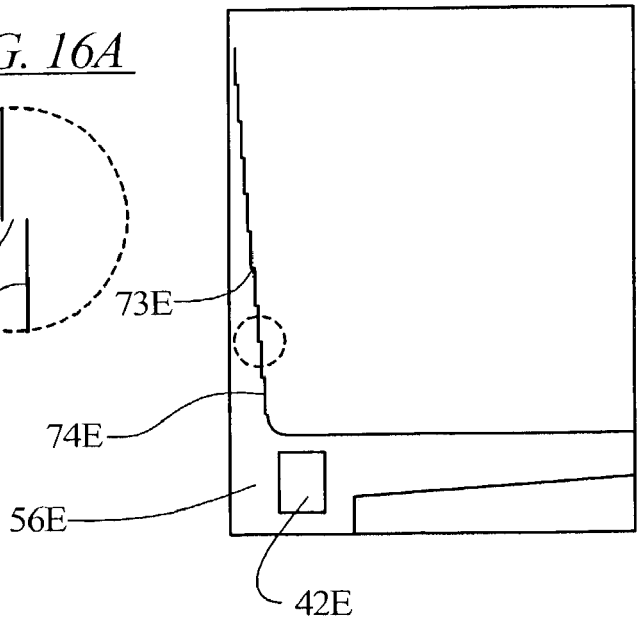

STATIONARY CLOTHES DRYING APPARATUS

BACKGROUND OF THE INVENTION

The present invention generally relates to stationary dryers and more particularly to a clothes dryer having a support over which air flow is directed, the support being stationary during the drying process.

Significant percentages of items that are washed are not dried in a tumble dryer. Estimates of percentages are as high as 40%. These items are typically dried hanging in ambient air or, if the danger of stretching exists, dried laying flat in ambient air. When drying in this manner, free convection is the primary mechanism of heat transfer. Free convection also carries away evaporated water in support of the necessary mass transfer.

Drying rates can be doubled or tripled in comparison to free convection when common fans or blowers are used to provide conventional parallel flow forced convection heat transfer. Heat transfer rates may also be greatly increased for conventional forced convection, however fan/blower cost will typically rise exponentially with increased heat transfer rate.

For some fabrics, drying, while initially fast, may become slower later in the drying cycle due to the need to break mechanical and chemical bonds that limit the amount of "free" water available for evaporation. Normally this binding is more easily broken as temperatures are elevated.

Drying devices have been built in the past in which items may be placed to dry in a forced convection air stream that is typically heated. For example, EP 0 933 465 discloses a stationary clothes dryer having a perforated plate for receiving a layer of clothing articles to be dried, through which a flow of heated air is directed. These drying devices include stationary supports as well as movable drawers. For example U.S. Pat. No. 5,870,836 discloses the use of porous shelf inserts that slide in horizontal slots. These devices have been effective in reducing the drying time in comparison to ambient drying, however, these designs have not reached their highest potential effectiveness. The primary reason that limitations exist in the prior art designs is the limited consideration that has been given to optimum heat transfer and air flow design. In some designs, air flow is diverted by one item to be dried such that drying of other items is effectively blocked.

SUMMARY OF THE INVENTION

The present invention provides an improvement over known stationary clothes dryers in that it provides an air distributor mechanism comprising a distribution plenum positioned between an air inlet and a clothes supporting surface which may be generally horizontal or vertical and porous or non-porous. The plenum has a wall with a plurality of perforations therein, and the perforations are sized, shaped and arranged so as to equalize an air flow distribution over and perhaps through the support surface. In an embodiment where the air flow through the stationary clothes dryer is maintained at a relatively high rate, but with a low pressure drop, the wall of the distribution plenum has a greater porosity near the air flow inlet than farther away.

The air distributor mechanism may also include a supply plenum arranged between an air inlet and the distribution plenum to direct the air flow from the air inlet to the distribution plenum.

The distribution plenum can be arranged at one more sides of the clothes support and can introduce the air flow to the drying chamber one or more of, above the support surface, below the support surface and to either side of the surface. An air outlet, likewise can be positioned above, below and to either side of the surface.

The air outlet can be positioned at a longitudinal end of the porous surface or, in some configurations, it can be positioned at one of the lateral sides, opposite the lateral side having the perforated plenum wall.

BRIEF DESCRIPTION OF THE DRAWINGS

FIG. 15 is an enlarged schematic side sectional view of the air distributor plenum.

FIG. 15A is an enlarged schematic side sectional view of the air inlet openings.

FIG. 16 is an enlarged schematic side sectional view of the exhaust plenum.

FIG. 16A is an enlarged schematic side sectional view of the air exhaust openings.

DETAILED DESCRIPTION OF THE PREFERRED EMBODIMENT

A stationary dryer incorporating the principles of the present invention can be practiced in many different embodiments. Some of these embodiments are shown and described herein, however, the present invention is not limited to the particular embodiments contained in this description.

The term stationary dryer is meant to cover drying devices in which the articles being dried remain relatively stationary during the drying process. The dryer itself may be movable to different locations and various components of the dryer may be moveable, particularly when the articles to be dried are being placed into or removed from the dryer. While such a device could be used to dry a wide variety of articles, for the purposes of providing an enabling disclosure of the best mode of the invention, embodiments are described below for drying clothing or other fabric articles, however, the invention is not limited to such specific uses.

Figure 1:
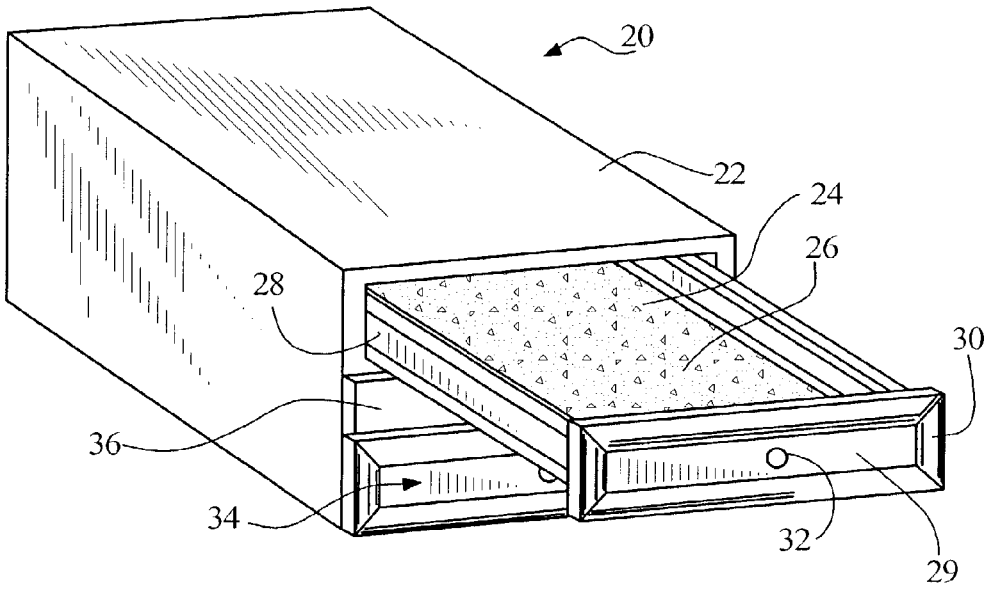
FIG. 1 is a perspective view of a stationary clothes dryer embodying the principles of the present invention.

In FIG. 1 there is illustrated a stationary clothes dryer generally at 20, in one form, which includes a housing 22 enclosing an interior space 24. A clothes support 26 is located within the space 24 and comprises a substantially horizontal surface which may be flexible and porous, such as an open netting or screen material, or may be rigid and solid or may have a plurality of openings therethrough. Preferably the surface 26 is sufficiently stable so as to support a typical clothes load, such as a wet sweater or similar clothing article without unduly sagging or distending. The surface 26 may be porous. This surface, while it may be movable for loading and unloading articles for drying, remains generally stationary during the drying process, and is referred to herein as a stationary support surface.

In the embodiment illustrated in FIG. 1, the stationary clothes dryer 20 is depicted as a stand alone appliance, although it can be incorporated into other cabinetry or appliances as desired.

The support surface 26 is illustrated in FIG. 1 as being mounted on a movable slide member 28, in the form of a drawer 29 with a drawer front 30 and a manually graspable pull 32 to allow the surface 26 to be slid into and out of the housing 22 to load and unload clothing and fabric items on the surface. In other embodiments the surface 26 may be fixed in place with other arrangements made for loading and unloading clothing items from the surface, such as openable doors into a space above the surface.

Also, in FIG. 1, a second drawer 34 is illustrated in a closed position, demonstrating that the stationary clothes dryer may include more than one support surface 26 for receiving items to be dried. Any number and arrangement of such support surfaces can be utilized in the stationary clothes dryer. In the embodiment illustrated in FIG. 1, a space indicated by trim piece 36 is provided between the upper drawer 29 and the lower drawer 34 to accommodate an air plenum as described below. The precise placement and arrangement of the air plenum can be modified, in accordance with the various embodiments described below.

Figure 2:
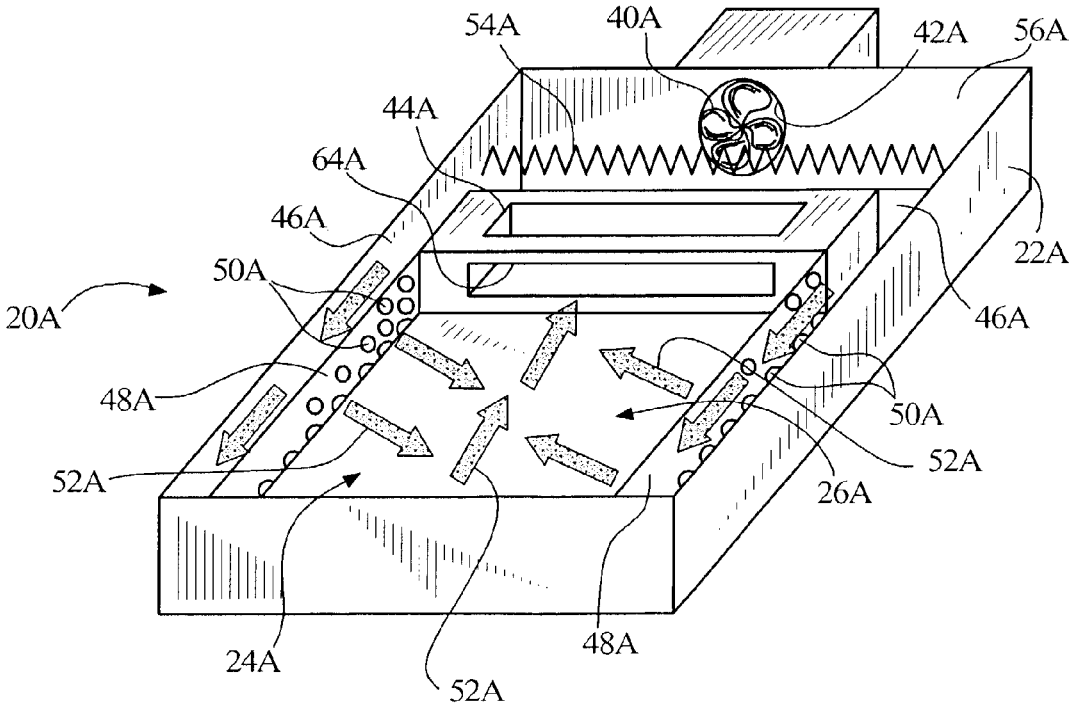
FIG. 2 is a schematic perspective view of the interior of one drawer of the stationary clothes dryer of FIG. 1.
Figure 3:
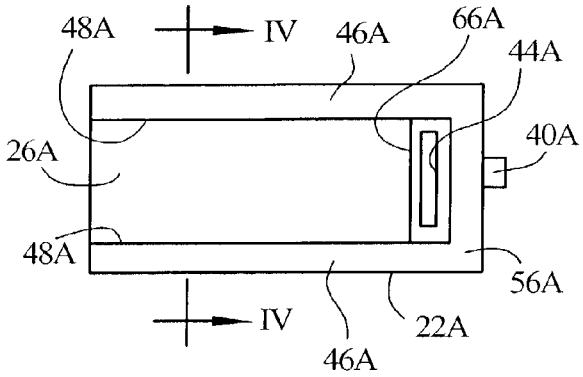
FIG. 3 is a schematic plan view of the stationary clothes dryer of FIG. 2.
Figure 4:
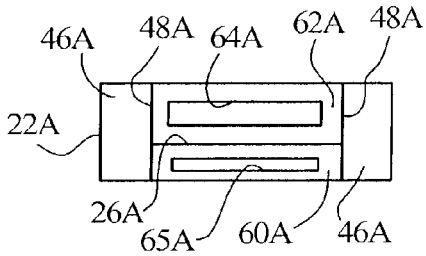
FIG. 4 is a schematic sectional view taken generally along the line IV—IV of FIG. 3.

In FIGS. 2–4, a first embodiment of a stationary clothes dryer 20A is illustrated, schematically, to show the interior components thereof. The clothes dryer 20A includes a housing 22A for enclosing a space 24A. A substantially horizontal support surface 26A, which may be porous, is positioned in the interior of the space 24A for receiving a load of articles to be dried. As described above, the horizontal surface 26A can be fixed or slidable or otherwise movable relative to the housing 22A.

The clothes dryer 20A includes an air moving device 40A, which may be in the form of a motor operated fan, to generate an air flow in a downstream direction through the space 24A from an air inlet 42A to an air outlet 44A. An air distributor mechanism comprising a distribution plenum 46A is positioned between the air inlet 42A and upstream of the horizontal support surface 26A. The distribution plenum 46A has a plenum wall 48A having a plurality of perforations 50A therein. The perforations can be round, oval, square, rectangular, slot-shaped, curved, or configured in other shapes as desired to provide the desired air flow. The perforations 50A are sized, shaped and arranged so as to equalize an air flow distribution, as indicated by arrows 52A. An optional heating element 54A is provided between the air inlet 42A and upstream of the surface 26A.

In operation, the fan 40A causes air to flow in through the air inlet 42A to a supply plenum 56A which includes therein the heating element 54A. There, if the heating element 54A is energized, the air is heated and flows downstream to the distribution plenum 46A. In this embodiment, there are two distribution plenums 46A located on opposite lateral sides of the support surface 26A. As seen in FIG. 4, the distribution plenum 46A extends both above and below the support surface 26A and the plenum wall 48A preferably includes openings in the areas both above and below the support surface 26A. In this manner, air flow from the plenums 46A flow into a space 60A beneath the surface 26A as well as into a space 62A above the surface. An air outlet opening 64A is positioned in a wall 66A located at one longitudinal end of the surface 26A into which the air flows, before exiting from the air outlet 44A. The outlet opening 64A is positioned above the support surface 26A. A second outlet opening 65A is positioned below the support surface also in the wall 66A and leads to air outlet 44A. Of course, two or more of the air outlet openings 64A, 65A and outlet 44A could be one and the same.

In this embodiment, thus, air flows above and below the support surface 26A, to flow over an upper surface of the clothing and below a lower surface of the clothing, in a generally lateral and longitudinal fashion as shown in FIG. 2, to effect a drying by air flow over all surfaces of the garment, particularly where the support surface is porous or relatively open.

The air outlet opening 64A could alternatively be the only outlet opening, particularly where the support surface 26A is not porous. In this case, the plenums 46A would extend only above the surface 26A. In this arrangement, air would flow only over the upper exterior surface of the clothing article.

It is desirable that the porosity of the plenum walls 48A be arranged so that air flow over the support surface 26A is equalized. By this it is meant that a relatively even distribution of air flow is provided throughout the area of the support surface 26A rather than having the air flow predominately located at one end or another, or around the edges, or only through the center.

One way to achieve the generally equalized air flow, particularly in an arrangement where a fairly high velocity air flow, such as 0.2–0.3 m/s flows through the distribution plenum 46A, where there is a minimal pressure drop through the plenum wall 48A, is to increase the porosity of the plenum wall at an upstream side thereof closest to the fan 40A (when it is in a position to push air through the plenum 46A) in that, in the arrangement illustrated, the velocity of the air flow will tend to cause the air to flow past in the initial openings in the distribution plenum rather than through the openings. By increasing the porosity at the upstream end of the wall 48A, the air flow through the plenum wall along the length of the plenum 46A can be equalized. Similarly, decreasing the porosity at the downstream end of the plenum 46A, where the air flow tends to go to due to the straight elongated arrangement of the plenum and the momentum of the moving air, will tend to equalize the air flow over the support surface 26A. A method for increasing (or decreasing) the porosity of the wall 48A is to change the size, spacing configuration and/or layout of the perforations 50A through the wall.

Figure 5:
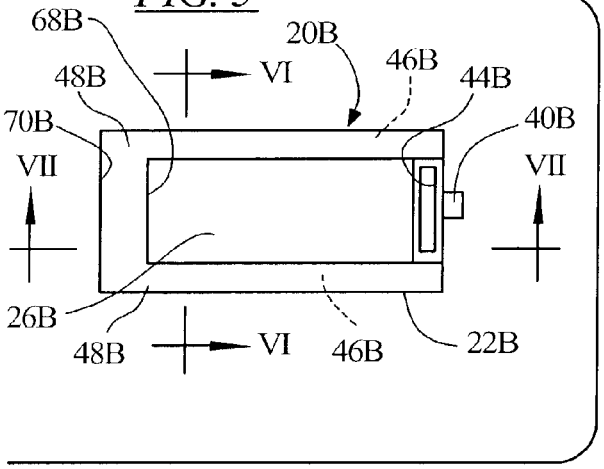
FIG. 5 is a schematic plan view of a second embodiment of the clothes dryer of FIG. 1.
Figure 6:
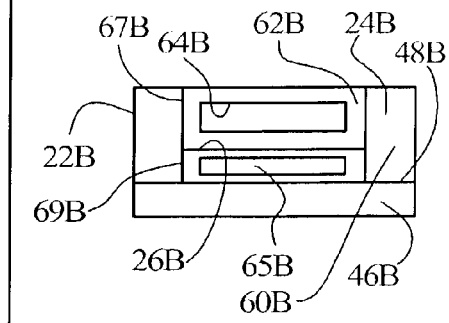
FIG. 6 is a sectional view taken generally along the line VI—VI of FIG. 5.
Figure 7:
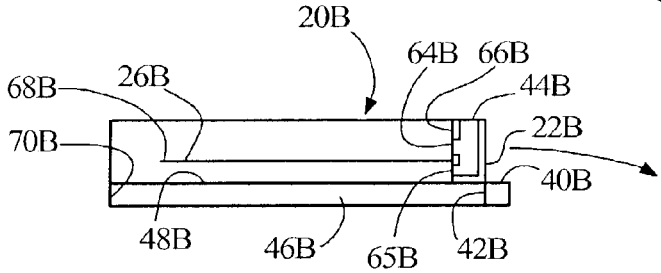
FIG. 7 is a sectional view taken generally along the line VII—VII of FIG. 5.

A second embodiment of the stationary clothes dryer 20B is illustrated in FIGS. 5–7 where it is seen that the clothes dryer 20B includes a housing 22B enclosing a space 24B with a stationary clothes support comprising a substantially horizontal surface 26B positioned within the enclosed space. An air moving device 40B is provided for generating an air flow through the space from an air inlet 42B to an air outlet 44B. An air distributor mechanism comprising a distribution plenum 46B is positioned between the air inlet 42B and the horizontal surface 26B and includes a plenum wall 48B having a plurality of perforations therein. In this embodiment, the distribution plenum 46B is positioned beneath the entirety of the surface 26B and the plenum wall 48B is generally horizontal so that the air will flow up through the plenum wall toward the air outlets 64B and 65B. The support surface 26B can be supported centrally within a space 60B such as by hangers 67B or posts 69B or other known support members so that air from the plenum wall 48B can flow both along and under the surface 26B as well as along and over the top of the support surface in space 62B in that the sides of the surface 26B can be left generally open to the space 60B. An end 68B of the support surface 26B may be spaced away from an end 70B of the plenum so that air flow can be equalized, even over the end of the support surface opposite the air outlet 64B. Alternatively, the support surface 26B may extend the full length and width of the space 24B, with porous areas provided at least along the margin areas of the support surface 26B to allow for air flow to the upper space 62B from the lower space 60B. The sizes of the air outlets 64B and 65B may be adjusted relative to one another to equalize the air flow over the top and bottom surfaces of support surface 26B as well.

Again, the porosity of the distribution plenum wall 48B preferably is arranged to allow for a generally equalized flow over the porous surface 26B. Of course, the position of the plenum 46B can be reversed, that is, it can be positioned above the support surface 26B, and, if desired, openings or spacings being provided to allow for a flow of air below the support surface to the air outlet 65B.

Figure 8:
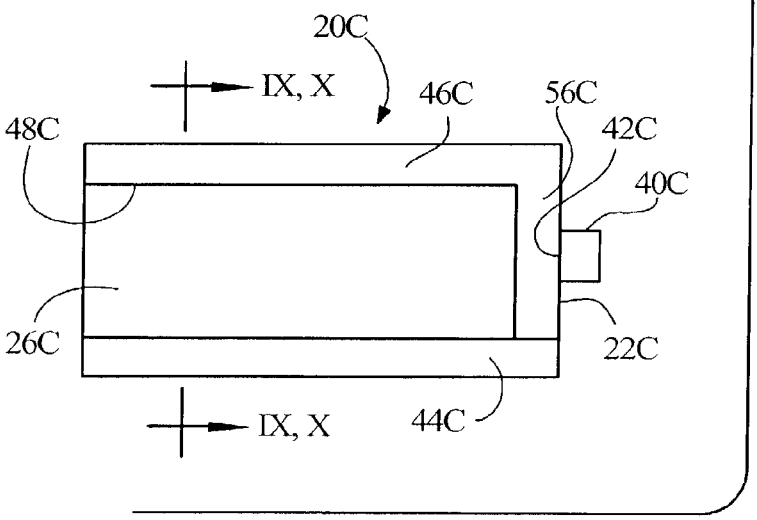
FIG. 8 is a schematic plan view of a third embodiment of the stationary clothes dryer of FIG. 1.
Figure 9:
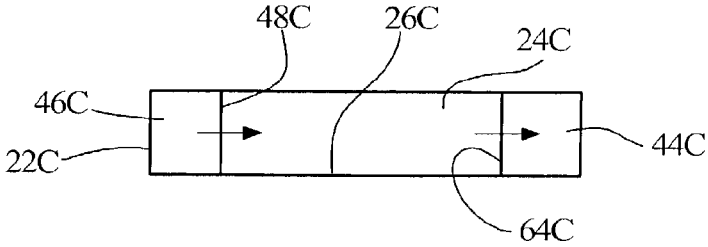
FIG. 9 is a sectional view taken generally along the line IX—IX of FIG. 8.
Figure 10:
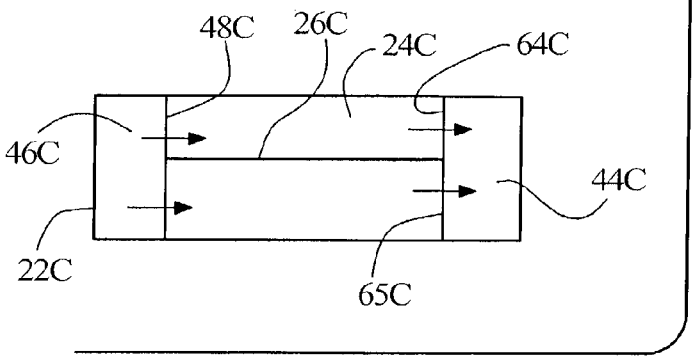
FIG. 10 is an alternative embodiment of the embodiment illustrated in FIG. 8.

A third alternate embodiment is illustrated in FIGS. 8–10. In this embodiment, the stationary clothes dryer 20C includes a housing 22C enclosing a space 24C and a stationary clothes support 26C is located within the space 24C comprising a substantially horizontal surface which optionally may be porous. An air moving device 40C is provided for generating an air flow through the space from an air inlet 42C to an air outlet 44C. An air distributor mechanism is provided which comprises a distribution plenum 46C positioned between the air inlet 42C and the support surface 26C, with a plenum wall 48C having a plurality of perforations therein. In this embodiment, the distribution plenum 46C is arranged along one lateral side of the support surface 26C and the air outlet 44C is positioned along an opposite lateral side. A supply plenum 56C extends between the air inlet 42C and the distribution plenum 46C. In a first arrangement of this embodiment, as illustrated in FIG. 9, the plenum wall 48*c* has perforations in an area only above the support surface 26C and the air outlet 44C has openings only above the support surface. The distribution plenum 46C is positioned on one side of the horizontal surface 26 and the exhaust outlet 64C is positioned on an opposite side of the porous surface. In this case, the plenum is on one lateral side of the horizontal surface and the exhaust outlet is on the opposite lateral side.

In the arrangement illustrated in FIG. 10, flow is provided both above and below the support surface. That is, in this arrangement perforations are provided in the plenum wall 48C above and below the support surface 26C and the exhaust outlets 64C and 65C are positioned above and beneath the porous surface. Again, the plenum and the exhaust outlet are on opposite sides, both opposite lateral sides, of the support surface.

Again, it is preferred that the porosity of distribution plenum wall 48C be arranged so as to provide a generally equalized flow over the support surface 26C which may require that the plenum wall have a greater porosity closer to the air moving device 44C as described above.

Figure 11:
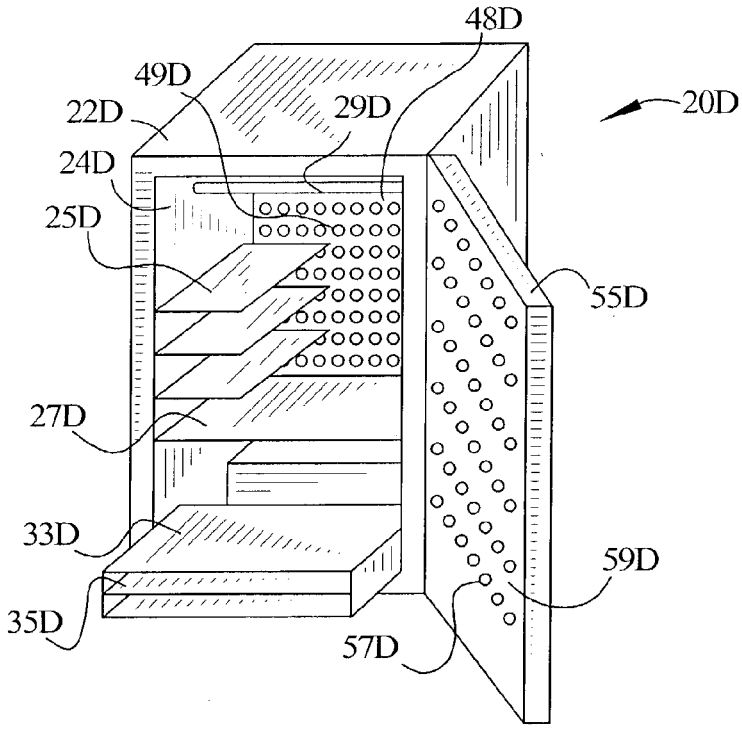
FIG. 11 is a perspective view of another embodiment of a stationary clothes dryer embodying the principles of the present invention.
Figure 12:
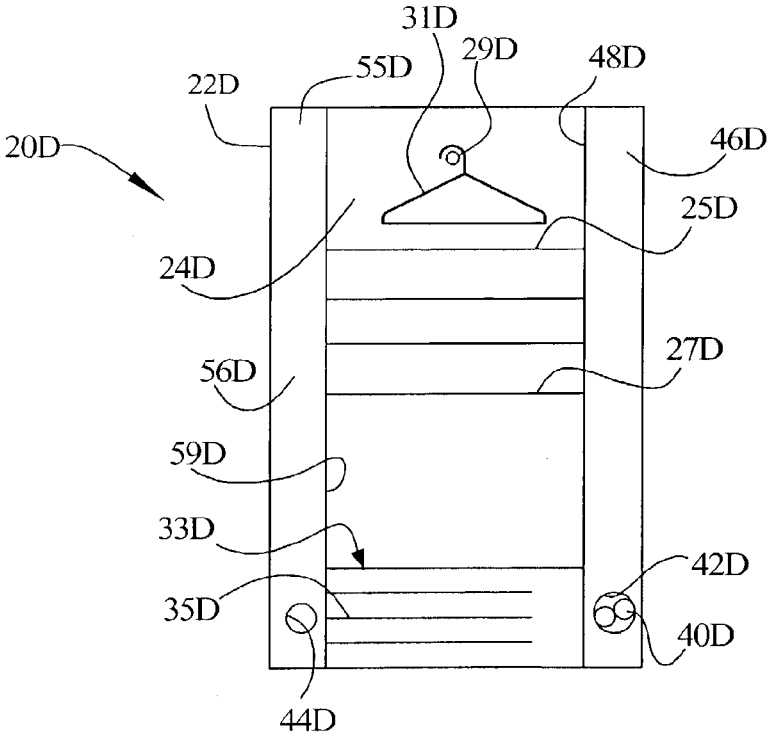
FIG. 12 is a schematic side sectional view of the embodiment of FIG. 11.

A fourth alternative embodiment is illustrated in FIGS. 11–12. In this embodiment, the stationary clothes dryer 20D includes a housing 22D enclosing a space 24D and a plurality of stationary clothes supports are located within the space 24D comprising half width 25D and full width 27D horizontal shelves, a hanger bar 29D for receiving one or more hangers 31D to vertically support an article to be dried, and a pull out drawer 33D with horizontal surfaces 35D. These various stationary clothes supports may have porous surfaces or non-porous surfaces. An air moving device 40D is provided for generating an air flow through the space 24D from an air inlet 42D to an air outlet 44D. An air distributor mechanism is provided which comprises a distribution plenum 46D positioned between the air inlet 42D and the various support surfaces, with a plenum wall 48D having a plurality of perforations 49D therein. In this embodiment, the distribution plenum 46D is arranged along a back side of the support surfaces and the air outlet 44D is positioned along an opposite, front side which comprises an openable door 55D. An exhaust plenum 56D extends between a plurality of perforations 57D in an interior panel 59D of the door 55D and the air outlet 44D. Preferably the perforations 49D in the distribution plenum wall 48D are sized, shaped and arranged to provide an equalized air flow distribution over the various support surfaces.

Figure 13:
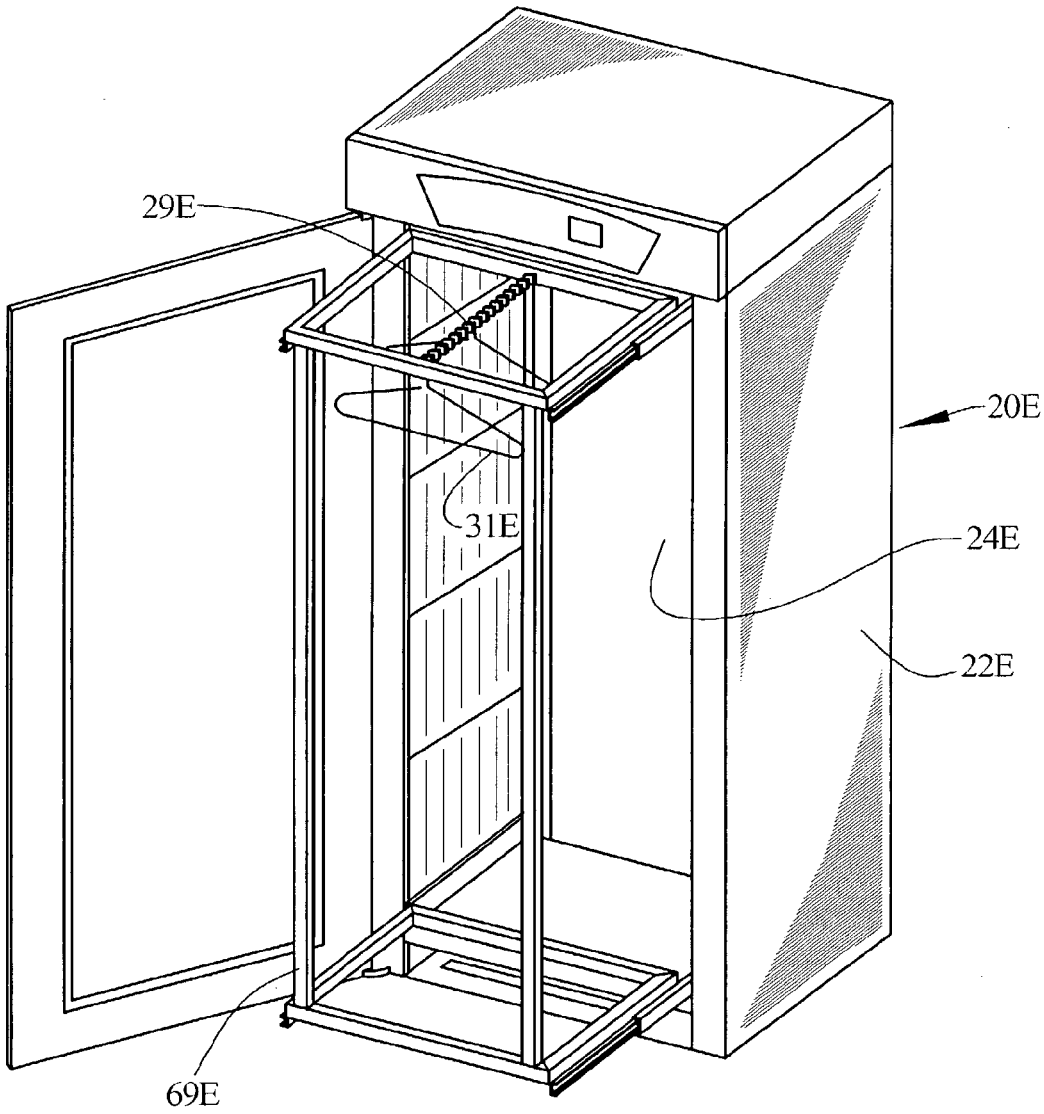
FIG. 13 is a front perspective view of another embodiment of a stationary clothes dryer embodying the principles of the present invention.

FIGS. 13–16 illustrate a fifth alternative embodiment. In FIG. 13, the stationary clothes, dryer 20E is schematically illustrated in a front perspective view. In this embodiment, the stationary clothes dryer 20E includes a housing 22E enclosing a space 24E and a plurality of stationary clothes supports are located within the space 24E comprising a hanger bar 29E for receiving one or more hangers 31E to vertically support an article to be dried. Various shelves and drawers may also be provided as discussed with respect to previous embodiments. These various stationary clothes supports may have porous surfaces or non-porous surfaces. An air moving device 40E (FIG. 14) in the form of a recirculating fan is provided for generating an air flow in a downstream direction through the space 24E from an air inlet 42E (FIGS. 144, 16) to an air outlet 44E (FIGS. 14, 15), preferably with a majority of the air flow being recirculated. As best shown FIG. 14, an air distributor mechanism is provided which comprises a distribution plenum 46E positioned upstream of the various support surfaces, with a plenum wall 48E having a plurality of perforations 50E (FIGS. 15, 15A) therein.

In this embodiment, the air flow through the interior of the dryer 20E is generally from side to side such that the air flow will be substantially parallel to the surface of the supported articles; including the articles supported by the hanger bar and hanger.

In this embodiment, the distribution plenum 46E is arranged along one side of the support surfaces and an exhaust/supply plenum 56E (FIG. 16) is arranged along an opposite side. In this embodiment, the shape of the distribution plenum 46E, as well as the size, shape and arrangement of the perforations 50E in the plenum wall 48E provide an equalized air flow distribution over the various support surfaces. Also, the exhaust/supply plenum 56E may have a shape that assists in even flow distribution, as well as perforations of a size, shape and arrangement to assist in the air flow distribution.

FIG. 15 schematically shows the distribution plenum 46E leading from the exhaust/supply plenum 56E. The distribution plenum 46E is shaped in a narrowing taper in a downstream direction. That is, the distribution plenum 46E extends in a direction along the air flow and decreases in cross sectional area in the downstream direction. Further, the perforations 50E in the plenum wall 48E are configured as vanes 71E arranged in a ladder or staggered orientation to assist the airflow in changing direction from essentially parallel to the plenum wall 48E to through the plenum wall. The vanes, as shown in FIG. 15A, are preferably perforated as well as at 72E, along their length, to prevent the formation of a recirculation zone in the air flow.

FIG. 16 schematically shows the exhaust/supply plenum 56E leading towards the recirculation fan 40E. The exhaust/supply plenum 56E is shaped in an expanding taper in a downstream direction toward the recirculation fan 40E in an area of a wall 74E defining a portion of the exhaust/supply plenum 56E. Further, perforations 73E are provided in the wall 74E of the exhaust/supply plenum 56E in the form of slits, as shown in FIG. 16A, which help direct the air flow exhausting from the space 24E into the exhaust/supply plenum in such a way (nearly parallel to the wall 74E and from the front) so as to maintain an even flow of air through the interior 24E of the dryer and over the support surfaces. The exhaust/supply plenum 56E first acts as an exhaust plenum for the air flow leaving the dryer space 24, and then as a supply plenum for the air flow approaching the recirculation fan 40E. Thus, the exhaust/supply plenum is positioned downstream of the dryer space 24E as well as upstream of the distribution plenum 46E.

Figure 14:
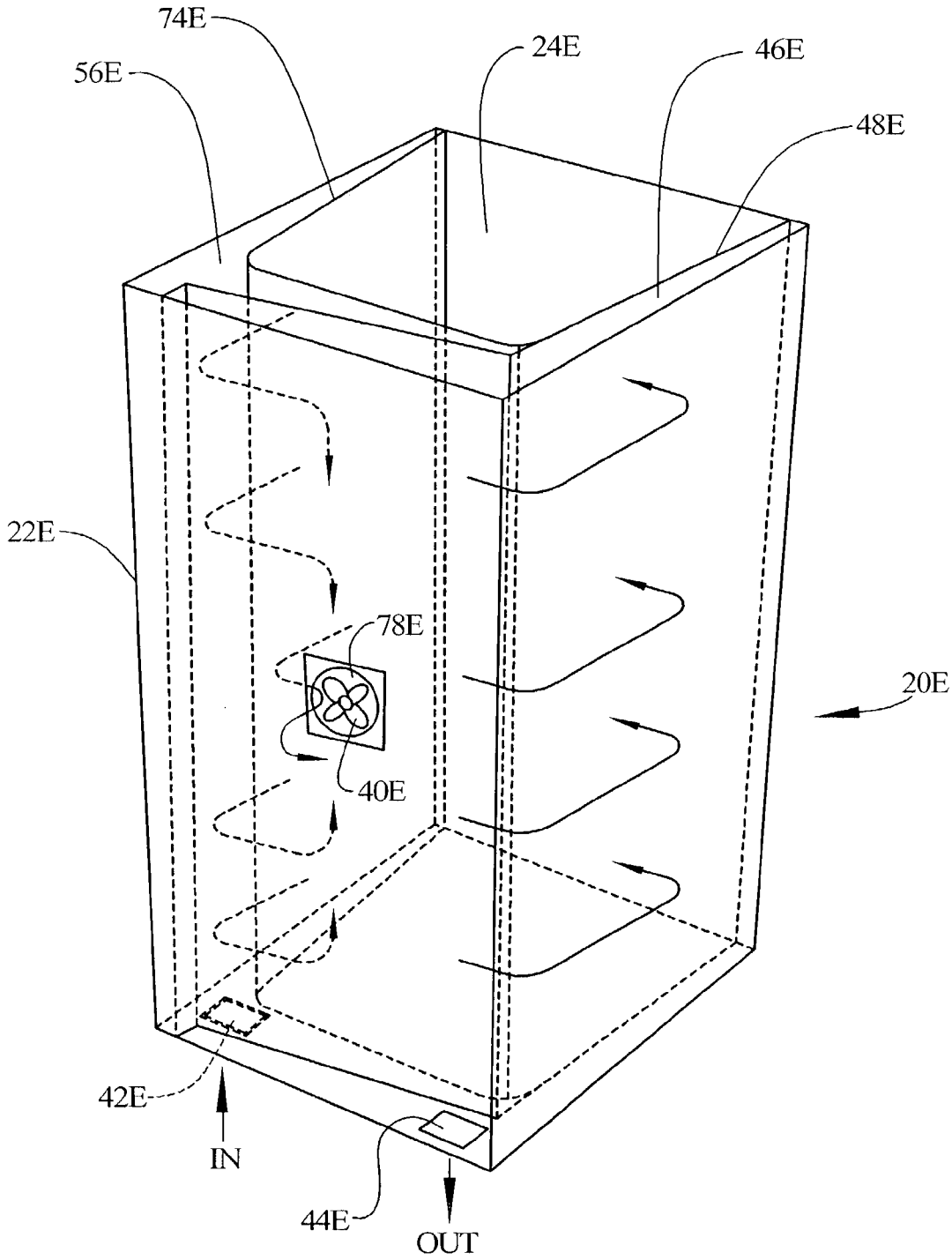
FIG. 14 is a rear perspective view of the stationary clothes dryer of FIG. 13.

Recirculation arrangements in the air distributor mechanism, of appropriate and optionally controllable openings and ducts or passages shown schematically at 42E, 44E and 78E in FIG. 14 are provided to allow for a recirculation of all or a part of the air flowing through the stationary dryer of any of the embodiments described.

In each of the embodiments, although not illustrated, the heating element as shown in FIG. 2 and arranged upstream of the space 24 could be utilized to provide heated air to aid in the drying operation. Further, the air moving device can be located at other locations along the air flow path, so as long as an air flow is generated to flow over one or more surfaces of the article support surface. Recirculation rates and percentages can be modified to produce the desired results.

It will be appreciated, from the above description, that the air distributor mechanism comprising the distribution plenum can be sized and arranged in several different configurations, as can the size and position of the air outlet, without departing from the principles of the present invention.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A stationary dryer comprising:

a housing enclosing a space, a horizontal support located within said space for supporting an article in a horizontal plane, an air moving device for generating an air flow through said space in a downstream direction, an air distributor mechanism comprising a distribution plenum positioned in said air flow, upstream of said support, with a plenum wall having a plurality of perforations therein, said distribution plenum and said perforations arranged so as to direct an air flow over said support in a first direction generally parallel to said plane and in a second, different direction generally parallel to said plane, and an air exhaust outlet arranged so as to receive said air flow from a third, different direction generally parallel to said plane.

2. A stationary dryer according to claim 1, wherein said support comprises a generally horizontal porous surface.

3. A stationary dryer according to claim 1 wherein said distribution plenum comprises a pair of spaces, one located on each lateral side of said horizontal porous surface.

4. A stationary dryer according to claim 1, wherein said air distributor mechanism comprises a supply plenum arranged upstream of said distribution plenum to direct said air flow to said distribution plenum.

5. A stationary dryer according to claim 1, wherein said plenum wall of said distribution plenum extends above and below said support, such that said air flow is introduced both above and below said support by said distribution plenum.

6. A stationary dryer according to claim 1, wherein said support is horizontal and said perforations are below said support and said exhaust outlet is above said support.

7. A stationary dryer according to claim 1 wherein said perforations are at one lateral side of said support and said exhaust outlet is at an opposite lateral side of said support.

8. A stationary dryer according to claim 1, wherein said wall of said distribution plenum has a greater porosity at an upstream side thereof than at a downstream side thereof.

9. A stationary dryer according to claim 1 wherein said stationary support is mounted on a movable slide member allowing said support to be slid into and out of said housing to load and unload clothing items on said support.

10. A stationary dryer according to claim 1 wherein said distribution plenum decreases in cross sectional area in a downstream direction.

11. A stationary dryer according to claim 1, including an exhaust plenum positioned downstream of said support.

12. A stationary dryer according to claim 1, including recirculation passages in said air distributor mechanism.

13. A stationary dryer comprising:

a housing enclosing a space, a support located within said space for supporting an article in a plane, an air moving device for generating an air flow through said space in a downstream direction, an air distributor mechanism comprising a distribution plenum positioned in said air flow, upstream of said support, with a plenum wall having a plurality of perforations therein, said distribution plenum and said perforations arranged to direct an air flow along said support in a first direction generally parallel to said plane, adjacent to at least one face of said support, an air exhaust outlet arranged to receive said air flow from a second, different direction generally parallel to said plane, but adjacent to at least an opposite face of said support, wherein said support comprises a horizontal porous surface, and wherein said distribution plenum comprises a pair of spaces, one located on each lateral side of said support.

14. A stationary clothes dryer according to claim 13, wherein said plenum wall of said distribution plenum extends above and below said horizontal porous surface, such that said air flow is introduced both above and below said horizontal porous surface by said distribution plenum.

15. A stationary clothes dryer according to claim 13, wherein said plenum perforations are positioned on an upstream side of said horizontal porous surface and an exhaust outlet leading to said air outlet is positioned on a downstream side of said horizontal porous surface.

16. A stationary clothes dryer according to claim 15 wherein said perforations are below said horizontal porous surface and said exhaust outlet is above said horizontal surface.

17. A stationary clothes dryer according to claim 15 wherein said perforations are at one lateral side of said horizontal porous surface and said exhaust outlet is at an opposite lateral side of said horizontal surface.

18. A stationary clothes dryer according to claim 13, wherein said air moving device comprises a fan positioned upstream of said distribution plenum.

19. A stationary clothes dryer according to claim 13, wherein said wall of said distribution plenum is positioned along said air flow and has a greater porosity at an upstream side thereof than at a downstream side thereof.

20. A stationary clothes dryer according to claim 13, wherein said distributor plenum decreases in cross sectional area in a downstream direction.

21. A stationary clothes dryer according to claim 13, wherein said support comprises an arrangement for hanging an article to be dried.

22. A stationary clothes dryer according to claim 13, including an exhaust plenum positioned downstream of said support.

23. A stationary clothes dryer according to claim 13, including recirculation passages in said air distributor mechanism.

24. A stationary clothes dryer comprising:

a housing enclosing a space, a stationary clothes support located within said space, a fan for generating an air flow through said space in a downstream direction, an air distributor mechanism comprising a supply plenum leading downstream to a distribution plenum positioned between said supply plenum and said stationary clothes support, said distribution plenum being located on a lateral side of said stationary clothes support, a distribution plenum wall extending along said air flow with an upstream end and a downstream end and having a plurality of perforations therein, said perforations being sized, shaped and arranged so as to equalize an air flow distribution over said stationary clothes support, said distribution plenum wall having a greater porosity towards said upstream end thereof than on said downstream end thereof.

25. A stationary dryer comprising:

a housing enclosing a space, a support located within said space, an air moving device for generating an air flow through said space in a downstream direction, an air distributor mechanism comprising a distribution plenum positioned in said air flow, upstream of said support, with a plenum wall having a plurality of perforations therein, said distribution plenum having an upstream end and a cross sectional area of said plenum tapering from a relatively larger area to a relatively smaller area in a direction leading downstream of said upstream end, wherein said perforations in said plenum wall comprise a series of vanes having portions extending into said distribution plenum and portions extending into said space.

26. A stationary dryer according to claim 25 wherein said distribution plenum and said perforations are arranged to direct said air flow from said distribution plenum into said space in a direction parallel to a support plane of said support.

27. A stationary dryer according to claim 25, wherein said vanes each have at least one perforation therein.

28. A stationary dryer according to claim 25 wherein said air distribution mechanism further comprises an exhaust plenum positioned downstream of said space, with a plenum wall having a plurality of perforations therein, said exhaust plenum having a downstream end and a cross sectional area of said plenum tapering from a relatively larger area to a relatively smaller area in a direction leading upstream of said downstream end.

29. A stationary dryer according to claim 28, wherein said exhaust plenum becomes a supply plenum for said air moving device.

30. A stationary dryer comprising:

a housing enclosing a space, a support located within said space, an air moving device for generating an air flow through said space in a downstream direction, an air distributor mechanism comprising a distribution plenum positioned in said air flow, upstream of said support, with a plenum wall having a plurality of perforations therein, said distribution plenum having an upstream end and a cross sectional area of said plenum tapering from a relatively larger area to a relatively smaller area in a direction leading downstream of said upstream end, wherein said perforations in said exhaust plenum wall comprise a series of slits arranged so as to redirect said air flow into a direction substantially parallel to said exhaust plenum wall.

31. A stationary dryer comprising:

a housing enclosing a space, a support located within said space, an air moving device for generating an air flow through said space in a downstream direction, an air distributor mechanism comprising a distribution plenum positioned in said air flow, upstream of said support, with a plenum wall arranged generally parallel to said airflow in said distribution plenum having a plurality of perforations therein, at least one of said distribution plenum and said perforations being sized or arranged in said wall so as to provide a greater porosity of said wall at an upstream end of said plenum wall and on an upstream side of said plenum wall in comparison to an area of said wall in a downstream direction and also on said upstream side of said plenum wall.

* * * * *